US007341069B2

(12) United States Patent
Satterthwaite

(10) Patent No.: US 7,341,069 B2
(45) Date of Patent: Mar. 11, 2008

(54) MULTI-PURPOSE AMBIO-UNIT

(75) Inventor: Robert J. Satterthwaite, U.S. Post Office Foxchase Station P.O. Box 24707, Philadelphia, PA (US) 19111

(73) Assignee: Robert J. Satterthwaite, Philadelphia, PA (US)

( * ) Notice: Subject to any disclaimer, the term of this patent is extended or adjusted under 35 U.S.C. 154(b) by 1017 days.

(21) Appl. No.: 10/286,969

(22) Filed: Jul. 25, 2002

(65) Prior Publication Data

US 2003/0159727 A1 Aug. 28, 2003

Related U.S. Application Data

(63) Continuation-in-part of application No. 09/694,891, filed on Oct. 26, 2000, now abandoned.

(51) Int. Cl.
*A45B 3/00* (2006.01)

(52) U.S. Cl. ..... 135/66; 312/330.1; 312/204

(58) Field of Classification Search ..... 135/65–67; 312/330.1, 204, 348.5

See application file for complete search history.

(56) References Cited

U.S. PATENT DOCUMENTS

| | | | | | |
|---|---|---|---|---|---|
| 1,425,559 | A | * | 8/1922 | Wampach et al. | 312/348.5 |
| D141,851 | S | * | 7/1945 | Schweitzer | D6/414 |
| 2,701,932 | A | * | 2/1955 | Hyman | 312/348.5 |
| 2,778,704 | A | * | 1/1957 | Joachim | 312/309 |
| D250,362 | S | * | 11/1978 | Williams | D26/58 |
| 4,449,750 | A | * | 5/1984 | Pultman | 312/235.2 |
| 4,848,588 | A | * | 7/1989 | Rasmussen | 206/581 |
| 5,129,397 | A | * | 7/1992 | Jingu et al. | 600/437 |
| 5,577,818 | A | * | 11/1996 | Sayre | 312/235.8 |
| 5,662,396 | A | * | 9/1997 | Reeder et al. | 312/209 |
| D457,756 | S | * | 5/2002 | Satterthwaite | D6/480 |

* cited by examiner

*Primary Examiner*—Janet M. Wilkens
(74) *Attorney, Agent, or Firm*—Robert J. Satterthwaite

(57) ABSTRACT

A hand-held walking device with a lower storage compartment having a generally u-shaped forward access area within. The walking device has an upper concealed compartment. A removeable false top panel side, under which several hidden compartments and a retractable drawer/shelf are stored. The walker includes a generally u-shaped support/handle.

7 Claims, 3 Drawing Sheets

MULTI-PURPOSE AMBIO-UNIT

This application is a continuation in process of Ser. No. 10/286,969—C.I.P. of Ser. No. 09/694,891 filed Oct. 26, 2000 now abandoned.

CROSS REFERENCE TO RELATED APPLICATION not applicable (N/A)

STATEMENT REGARDING FEDERALLY SPONSORED RESEARCH AND DEVELOPMENT (N/A)

REFERENCE TO A "MICROFICHE" APPENDIX (N/A)

BACKGROUND OF THE INVENTION

There can be no doubt that the population, in general, of the world is experiencing a dramatic increase in their life expectancy. This aging population, by and large, is being encouraged to stay mentally vigorous and to maintain an active positive interest in the world around them. Add to this, the number of persons of all ages who, for one reason or another, find themselves lame from having an injured/disabled leg or foot and who yet wish to be able to participate more conveniently in the life around them. Therefore, one can readily see the need for a Multi-Purpose Ambio-Unit. Unlike crutches, walkers, canes, etc., that have a singular purpose and by and large have an awkward appearance.

1. Field of the Invention

This invention relates generally to any of the various devices held in the hand and used by the lame people, (elderly and/or persons having an injured/disabled leg or foot), as an aid in walking.

2. Description of the Related Art

The Multi-Purpose Ambio Unit relates to other items that are designed to assist in walking, such as crutches, canes, walkers, etc.

SUMMARY OF THE INVENTION (8.) An object of the present invention is to provide a multi-purpose hand-held object as an aid in walking.

(9.) It is the provision of the multi-purpose functions to the user that sets apart this hand-held aid in walking, from other "held in the hand" assistance in walking devices.

(10.) In addition, to the assisting the user from walking from room to room—indoors to outdoors—and place to place, its multi-purpose features allows the user to engage in a variety of activities.

(11.) Another object of the invention is to provide an aid in walking that eliminates the awkward appearance that pertains to (crutches, walkers, canes, etc.) of other aids in walking.

(12.) Still another object of the invention is to provide a writing surface to its user. (See FIG. 1 and FIG. 2)

(13.) In addition, underneath the writing surface of the invention is a hidden compartment. Which can be used to conceal personal documents, photographs and appropriately small items, etc., (See FIG. 1 and FIG. 2) for first hidden compartment.

(14.) The device/invention also contains a convenient storage area for holding writing/sketching materials, books, papers, maps, etc. (See FIG. 1 and FIG. 4)

(15.) There is also within the invention another hidden compartment. The second hidden compartment is meant to conceal as well as accommodate writing paper and a letter that is yet not completed and to which one wants to return. (See FIG. 1 and FIG. 2) for second (2nd) compartment.

(16.) And the device/invention contains a small drawer for holding a pen/pencil, sketching implement, small artist paint brush, etc. (See FIG. 1 and FIG. 2)

(17.) The inherent portability of the invention allows those in need of walking assistance, not only such assistance; but gives them the opportunity to bring along with them their active, creative life.

(18.) The invention also may serve as a decorative piece of furniture.

(19.) There is also within the hidden drawer itself a use for a secondary writing surface. (See FIG. 1 and FIG. 2)

(20.) Another object of the drawer/shelf is the placement of small objects. (See FIG. 1 and FIG. 2)

(21.) The hidden drawer/shelf in itself is yet another compartment in that it in unobvious when disappearing into the concealed compartment unit. (See FIG. 1 and FIG. 2)

BRIEF DESCRIPTION OF THE INVENTION

Figure 3:
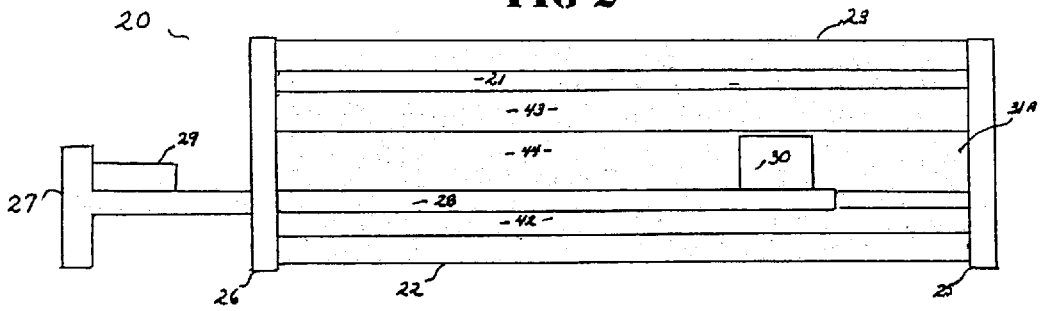

FIG. 3 in a front cross-sectional view illustrating the hidden spaces under the drawer/shelf and the hidden space atop the drawer/shelf. The hidden space between those concealed spaces.

Figure 4:
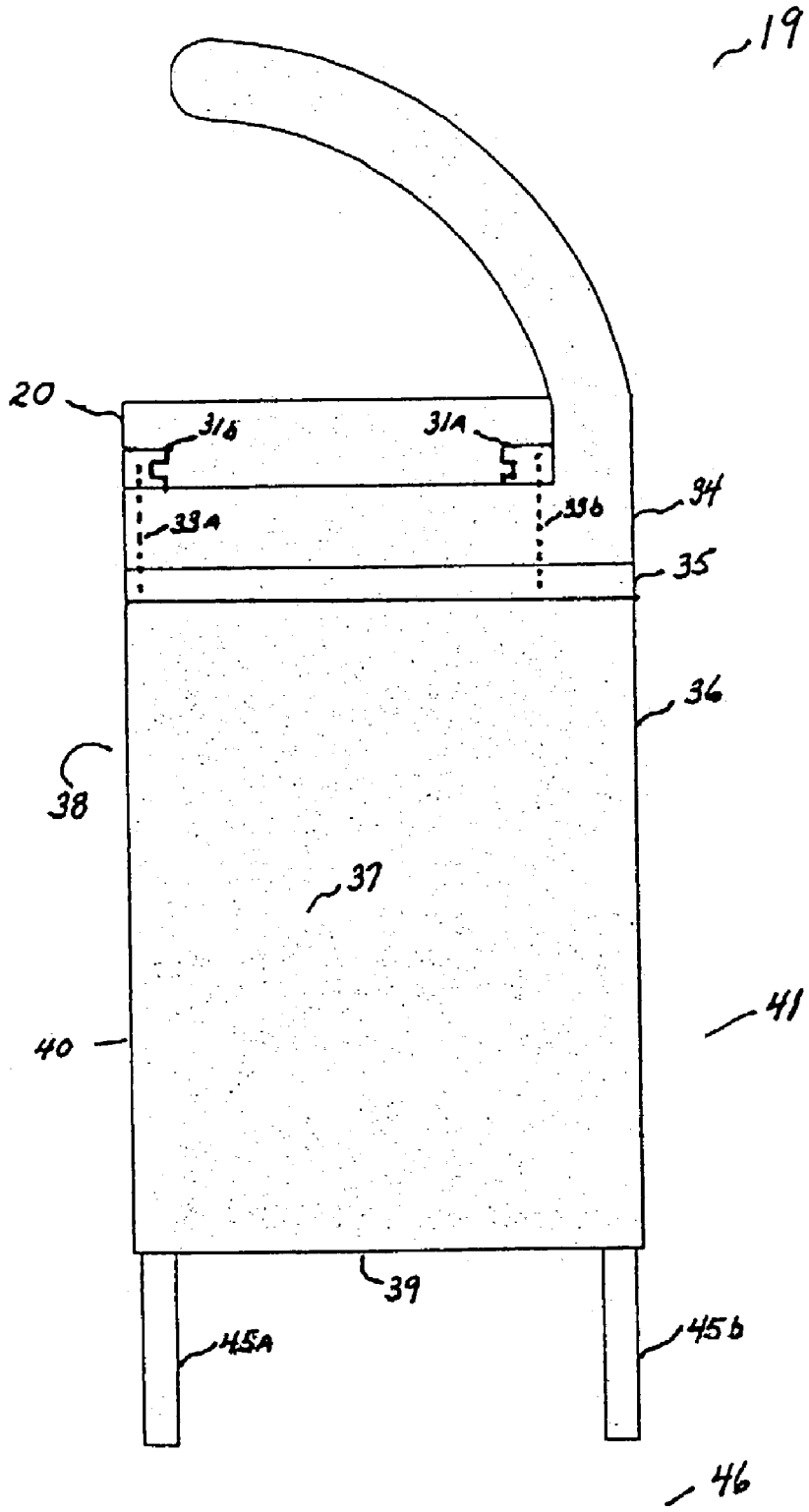

FIG. 4 is a side elevational/reverse side elevational view of a Multi-Purpose Ambio Unit with some revelational illustration to assembly.

DETAILED DESCRIPTION OF THE INVENTION

Figure 1:
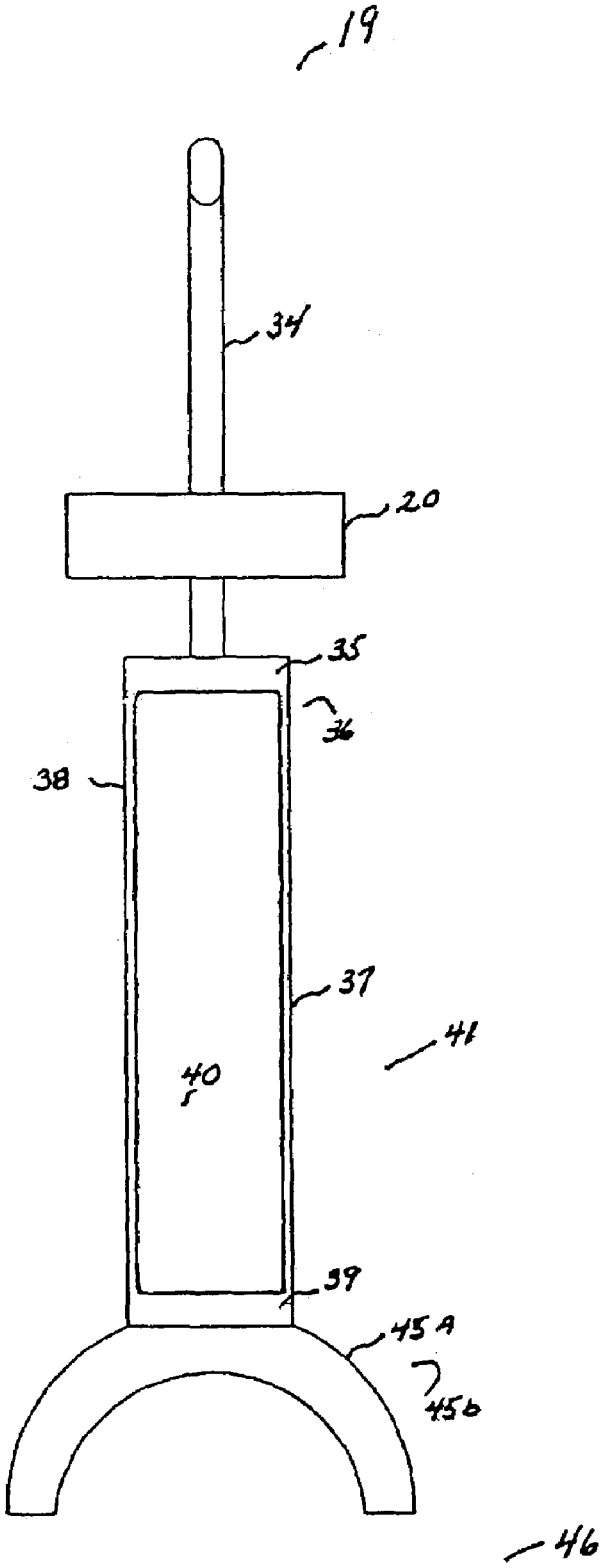
FIG. 1 is a front elevational view of a Multi-Purpose Ambio Unit in accordance with the principals of the present invention.
Figure 2:
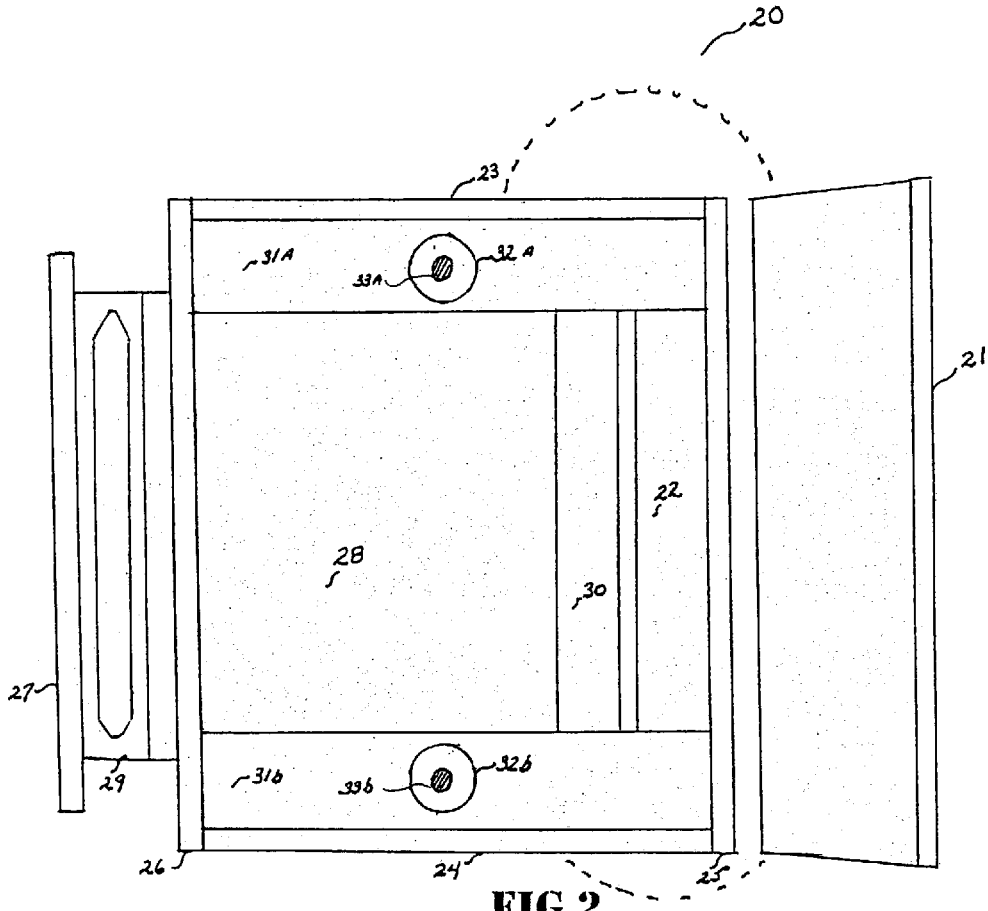
FIG. 2 is an aerial elevational view illustrating the locations and purpose of the hidden drawer/shelf and all hidden spaces/compartments.

Regarding FIG. 1 a Multi-Purpose Ambio Unit 19 includes a lower storage compartment 41 which forms an enclosure with access opening 40 to the storage compartment 41 which sits above two (2) crescent shaped support/legs 45*a*,45*b* above a floor 46. Atop the lower storage compartment 41 sits a base of a unshaped handle/support 34. Above the base of a u-shaped handle/support 34 rests a concealed compartment unit 20. In addition, the concealed compartment unit 20 has three (3) areas 42 43 44, one of which is a hidden drawer/shelf 28. (See FIG. 2 and FIG. 3). The Multi-Purpose Ambio Unit is a walker that is sized around and supported by the lower storage compartment 41 and a concealed compartment unit 20. The lower storage compartment 41 (See FIG. 1 and FIG. 4) is three (3) panel sided 36 37 38 with two (2) opposing panel sides 35 39, an upper and lower. The lower storage compartment 41 is preferably made of wood. Beneath the lower storage compartment 41 an the lower panel side 39 are two (2) crescent shaped support/legs 45*a* 45*b*, which are preferably wood and attached beneath the arch invertedly by four (4) screws. The unshaped handle/support 34 is made of wood and its base rests on the upper panel side 35 of the lower storage compartment 41. (See FIG. 4). The unshaped handle/support 34 faces forward, is open ended and has two (2) pre-drilled holes 33*a* 33*b* through its base.

In the concealed compartment unit 20 the location of the first (1) compartment (See FIG. 3) is in a space 42 under the drawer/shelf 28. A second (2) compartment 43 (See FIG. 3) is in a space above the drawer/shelf 28 and above the entire drawer/shelf space 44. The panel sides 23 24 25 26 of the concealed compartment unit 20 form an upper lip effect. When drawer/shelf 28 is closed this forms a supportive base for a second (2) concealed compartment 43. A third (3) hidden compartment 44. (See FIG. 3) is the existing drawer/shelf space 44. The assembly of a concealed compartment unit 20 has four (4) panel sides 23 24 25 26 preferably of wood and attached through panel sides 25 26. It has two (2) opposing panel sides 21 22, the lower panel side 22 has a slight recess. It is crescent shaped in form to accommodate the fingers. When reaching below the lower lip effect of the drawer/shelf 28 and drawer/shelf front 27. In opening the drawer/shelf 28 mounted atop the lowerpanel side 22 are two (2) drawer glides 31*a* 31*b*. That are commercially available of wood attached which accommodate a drawer/shelf 28. Affixed on top in a drawer/shelf stop 30 which adds support for weight displacement. The drawer/shelf stop 30 is mounted on the surface of the drawer/shelf 28. Also attached on the drawer/shelf 28 is a writing utensil tray 29 carved within to place a pen/pencil, small paint brush, etc. On the surface of the two (2) drawer glides 31*a* 31*b* are two (2) counter sunk holes 33*a* 33*b*, pre-drilled concealed beneath a false top panel side 21.

When inserting two (2) large screws (see FIG. 4) through drawer glide holes 33*a* 33*b* and through the base of a u-shaped handle 34, holes 33*a* 33*b* assemble a lower storage compartment 41 to a concealed compartment unit 20.

The invention, therefore, in its broadest aspects is not limited to the specific details shown and described. Accordingly departures may be made from the details described herein, departing from the spirit and scope of the invention.

What is claimed:

1. A hand-held walking device assembly formed to be located on a floor, the walking device assembly comprising:

a lower storage compartment having three side panels and opposing upper and lower panels, the panels defining an internal storage compartment with an access opening extending through a front side thereof;

support legs attached to the lower storage compartment adjacent the lower panel;

a generally U-shaped handle with a base attached to the lower storage compartment adjacent the upper panel; and a concealed compartment unit having four side panels, a lower panel and an unattached/false top panel, the concealed compartment unit connecting to a top portion of the base of the handle.

2. The hand-held walking device assembly of claim 1 wherein the concealed compartment unit further comprising:

a drawer/shelf slidingly mounted therein.

3. The hand-held walking device assembly of claim 2 wherein the concealed compartment unit further comprising:

a utensil tray mounted therein.

4. The hand-held walking device assembly of claim 2 wherein the concealed compartment unit further comprising:

a drawer/shelf stop mounted therein.

5. The hand-held walking device of claim 2 wherein the concealed compartment unit further comprising:

a drawer/shelf concealed compartment below a false top panel side concealed compartment; and a sub-drawer level concealed compartment therein.

6. A hand-held walking device assembly formed to be located on a floor, the walking device assembly comprising:

a lower storage compartment having three side panels and opposing upper and lower panels, the panels defining an internal storage compartment with an access opening extending through a front side thereof;

support legs attached to the lower storage compartment adjacent the lower panel;

a generally U-shaped handle with a base attached to the lower storage compartment adjacent the upper panel; and a concealed compartment unit having four side panels, a lower panel and an unattached/false top panel, the concealed compartment unit connecting to a top portion of the base of the handle and including;

a drawer/shelf mounted therein;

a utensil tray mounted therein;

a drawer/shelf stop mounted therein; and a drawer/shelf concealed compartment below a false top panel side concealed compartment; and a sub-drawer level concealed compartment therein.

7. A hand-held walking device assembly formed to be located on a floor, the walking device assembly comprising:

a lower storage compartment having three side panels and opposing upper and lower panels, the panels defining an internal storage compartment with an access opening extending through a front side thereof;

support legs attached to the lower storage compartment adjacent the lower panel;

a generally U-shaped support handle with a base attached to the lower storage compartment adjacent the upper panel; and a concealed compartment unit having four side panels, a lower panel and an unattached/false top panel, the concealed compartment unit connecting to a portion of the base of the handle.

* * * * *